US007345650B2

(12) United States Patent
Bae et al.

(10) Patent No.: US 7,345,650 B2
(45) Date of Patent: Mar. 18, 2008

(54) INTERNAL CHIP ANTENNA

(75) Inventors: Seok Bae, Kyungki-do (KR); Mano Yasuhiko, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 11/427,776

(22) Filed: Jun. 29, 2006

(65) Prior Publication Data

US 2007/0001925 A1 Jan. 4, 2007

(30) Foreign Application Priority Data

Jun. 30, 2005 (KR) ..... 10-2005-0058272

(51) Int. Cl.
*H01Q 1/36* (2006.01)

(52) U.S. Cl. ..... 343/895; 343/700 MS; 343/702

(58) Field of Classification Search ..... 343/700 MS, 343/702, 829, 846, 873, 895
See application file for complete search history.

(56) References Cited

U.S. PATENT DOCUMENTS 5,870,066 A * 2/1999 Asakura et al. ..... 343/895
6,064,351 A * 5/2000 Mandai et al. ..... 343/873
6,680,701 B2 * 1/2004 Sung ..... 343/700 MS
6,900,768 B2 * 5/2005 Iguchi et al. ..... 343/702
7,136,021 B2 * 11/2006 Huang et al. ..... 343/702
7,274,334 B2 * 9/2007 O'Riordan et al. ..... 343/702

FOREIGN PATENT DOCUMENTS

JP 2001352212 12/2001

* cited by examiner

*Primary Examiner*—Tho Phan
(74) *Attorney, Agent, or Firm*—Lowe Hauptman Ham & Berner

(57) ABSTRACT

The invention provides a chip antenna installed inside a mobile telecommunication terminal, which can process a low band signal. In the chip antenna, a substrate is prepared. A first radiator is formed in a spiral shape inside or on the substrate, and includes at least one spiral radiating part. The first radiator controls inductance of the antenna. Also, a second radiator is connected to the first radiator, and includes an upper meander radiating part disposed in a length direction of the substrate and a lower meander radiating part overlapping and opposing the upper meander in a lower part of the upper meander part. The second radiator controls capacitance of the antenna. In addition, a feeding part is connected to the first radiator, and receives a high frequency current of a given band.

9 Claims, 4 Drawing Sheets

INTERNAL CHIP ANTENNA

CLAIM OF PRIORITY

This application claims the benefit of Korean Patent Application No. 2005-58272 filled on Jun. 30, 2005 in the Korean Intellectual Property Office, the disclosure of which is incorporated herein by reference.

BACKGROUND OF THE INVENTION

1. Field of the Invention

The present invention relates to an antenna installed inside a mobile telecommunication terminal, for transmitting and receiving a wireless signal. More particularly, the present invention relates to a chip antenna installed inside a mobile telecommunication terminal, capable of processing a low band signal.

2. Description of the Related Art

Recently, a rising demand for wireless devices installed inside mobile telecommunication terminals has led to diversity in frequency bands used in an antenna of the terminals. Specifically, frequency bands currently used in the mobile telecommunication terminals include 800 MHz to 2 GHz (for mobile phones), 2.4 GHz to 5 GHz (for wireless LAN), RFID (113.56 MHz (for contactless RFID), 2.4 GHz (for Bluetooth), GPS 1.575 GHz (for GPS), 76 to 90 MHz (for FM radio), 470 to 770 MHz (for TV broadcasting) and other bands for ultra wideband (UWB), Zigbee, Digital Multimedia Broadcasting (DMB) and the like. The DMB band is classified into 2630 to 2655 MHz for satellite DMB and 180 to 210 MHz for terrestrial DMB.

Meanwhile, the mobile telecommunication terminals have been faced with demands for smaller size, lighter weight and various service functions as well. To meet such demands, the mobile telecommunication terminals tend to employ an antenna and other components which are more compact-sized and multi-functional. Furthermore, increasingly the mobile telecommunication terminals are internally equipped with the antenna. Therefore, to be installed inside the terminals, the antenna needs to occupy a very small space, while performing with satisfactory capabilities.

FIG. 1 is a structural view illustrating a conventional internal or built-in Planar Inverted F Antenna (PIFA).

The PIFA is an antenna designed for installation in a mobile telecommunication terminal. As shown in FIG. 1, the PIFA generally includes a planar radiator 2, a ground line 4 and a feeding line 5 connected to the radiator 2, and a ground plate 9. The radiator 2 is powered via the feeding line 5 and short-circuited to the ground plate 9 by the ground line 4 to achieve an impedance match. The PIFA needs to be designed by considering the length L of the radiator 2 and height H of the antenna in accordance with the width Wp of the ground line 4 and width W of the radiator 2.

The PIFA is characterized by directivity. That is, when current induced to the radiator 2 generates beams, a beam flux directed toward a ground surface is re-induced to attenuate another beam flux directed toward the human body, thereby improving SAR characteristics and enhancing intensity of the beam flux induced to the radiator 2. The PIFA operates as a rectangular micro-strip antenna, in which the length of a rectangular panel-shaped radiator is substantially halved, thereby realizing a low profile structure. Moreover, the PIFA is installed inside the terminal as an internal antenna so that the terminal can be designed with an aesthetic appearance and significantly withstand external impact.

The conventional internal antenna employs a high dielectric substrate so that it can be sized about 10 mm×10 mm at a frequency of 1 GHz or more. But in case where the antenna is required to process a frequency band of hundreds of MHz or less as in a mobile telecommunication terminal for terrestrial DMB, the antenna should be tens of centimeters in length (i.e., $\lambda$, $\lambda/2$ or $\lambda/4$, where $\lambda$ is a wavelength of a radio-wave). For example, since the terrestrial DMB antenna has a center frequency of 200 MHz, a monopol antenna should be 39 cm in length (free space wavelength/4). Therefore, disadvantageously, the conventional internal antenna cannot process low band frequencies of e.g., terrestrial DMB. Also, the antenna should be sized 5 cm or less to be installed inside the mobile telecommunication terminal such as a portable phone. As a result, the antenna manufactured according to a conventional built-in technology is sized tens of cm or more, thus disadvantageously lacking applicability as an internal antenna.

SUMMARY OF THE INVENTION

The present invention has been made to solve the foregoing problems of the prior art and therefore an object according to certain embodiments of the present invention is to provide a small-sized antenna installed inside a mobile telecommunication terminal, capable of easily controlling impedance.

According to an aspect of the invention for realizing the object, there is provided an internal chip antenna comprising: a substrate; a first radiator for controlling inductance of the antenna, the first radiator formed in a spiral shape inside or on the substrate, and including at least one spiral radiating part; a second radiator for controlling capacitance of the antenna, the second radiator connected to the first radiator and including an upper meander radiating part disposed in a length direction of the substrate and a lower meander radiating part overlapping and opposing the upper meander radiating part in a lower part of the upper meander part, and a feeding part for receiving a high frequency current of a given band, the feeding part connected to the first radiator.

Preferably, the substrate comprises ferrite or ferrite-resin composite.

Also, preferably, the spiral radiating part includes a conductive upper loop and a conductive lower loop formed in a substantially square shape, the upper and lower loops electrically connected to each other.

Preferably, the spiral radiating part has at least one intermediate loop with a substantially square shape disposed between the upper and lower loops, the intermediate loop electrically connected to the upper and lower loops.

Preferably, the upper and lower loops of the spiral radiating part are stacked in a thickness direction of the substrate.

Moreover, preferably, the first radiator has a plurality of spiral radiating parts each having upper and lower loops, each of the upper and lower loops electrically connected to an upper or lower loop of an adjacent spiral radiating part.

Preferably, the upper meander radiating part and the lower meander radiating part are electrically connected.

In addition, preferably, the radiating part and the lower meander radiating part are equally patterned, opposing each other in a symmetric configuration.

The internal chip antenna may further comprise a ground part for grounding the antenna, the ground part formed on an end of an underside of the substrate.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Figure 1:
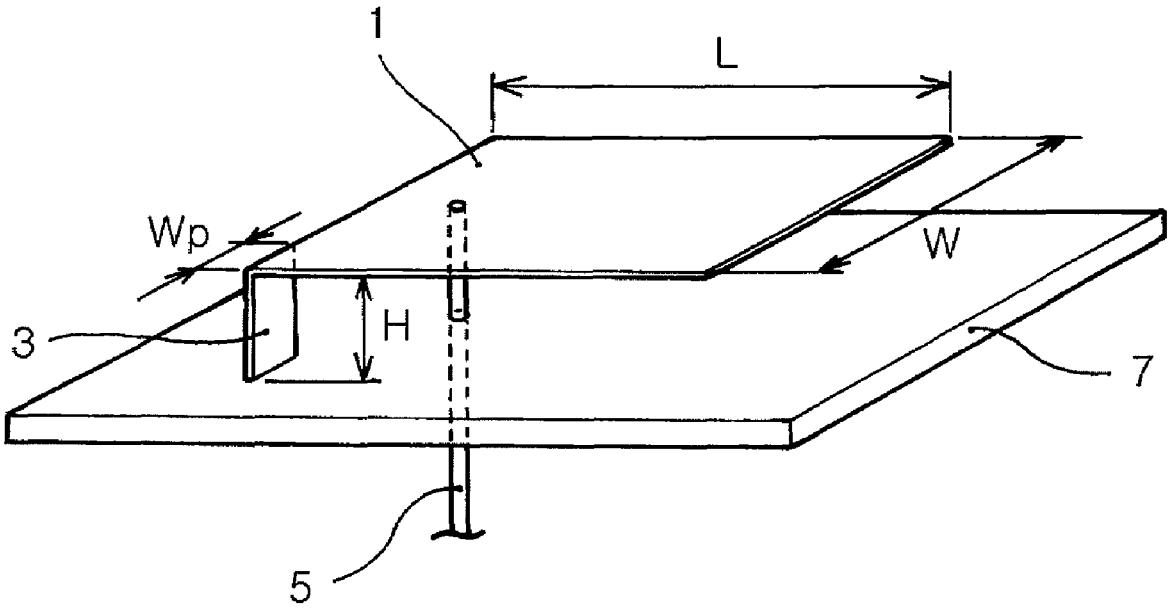
PRIOR ART FIG. 1
FIG. 1 is a structural view illustrating a PIFA according to the prior art.

Preferred embodiments of the present invention will now be described in detail with reference to the accompanying drawings, in which the same reference numerals are used throughout the different drawings to designate the same or similar components. In the following description, well-known functions and constructions are not described in detail since they would obscure the intention in unnecessary detail.

Figure 2:
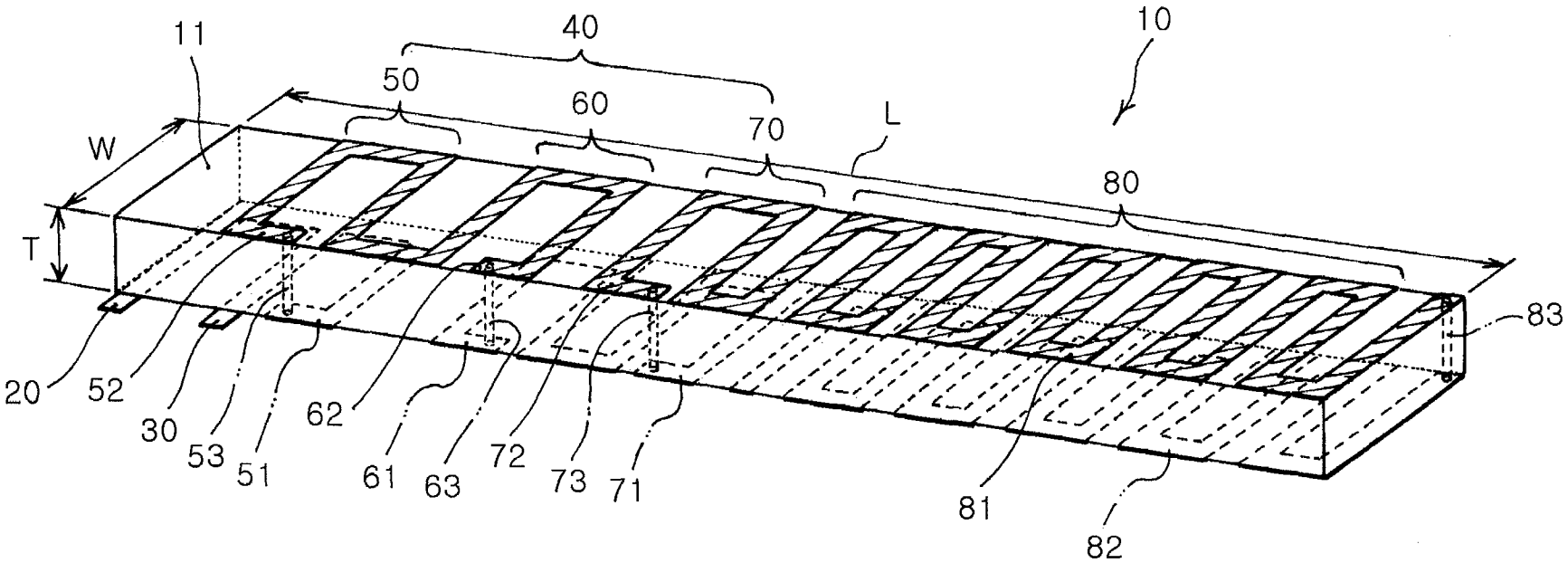
FIG. 2 is a configuration view illustrating an internal chip antenna according to an embodiment of the invention.

FIG. 2 is a configuration view illustrating an internal or built-in chip antenna according to an embodiment of the invention.

Referring to FIG. 2, the chip antenna 10 according to the embodiment of the invention includes a substrate 11, a ground part 20, a feeding part 30, a spiral first radiator 40, and a meander-shaped second radiator 80. To ensure the chip antenna 10 to be used in a low frequency band of e.g., terrestrial DMB as an ultra-small structure, the substrate 11 is made of a magnetic dielectric material. Also, to achieve an impedance match easily, the first and second radiators 40 and 80 are structured so as to have the greatest length in a small space.

Preferably, the substrate 11 has a substantially rectangular parallel piped configuration and may be ultra-small sized with a length L of 20 mm, width W of 3 mm and thickness T of 1 mm. Also, the substrate 11 is made of a magnetic dielectric material such as ferrite or ferrite-resin composite having both magnetic and dielectric properties for the reasons stated later. To form the ferrite-resin composite, particles of at least one kind of magnetic material selected from a group consisting of ferrite, magnetic metal and amorphous substance are dispersed by means of at least one organic material selected from a group consisting of epoxy, phenol, nylon and elastomer. Alternatively, the ferrite-resin composite may be made of a magnetic oxide having at least two kinds of elements selected from a group consisting of Fe, Ni, Co, Mn, Ba, Sr and Zn.

A reduction rate of a resonant length, which fundamentally determines miniaturization of the antenna, is expressed by Equation 1:

$$\frac{\lambda}{\lambda_0} = \frac{1}{\sqrt{\varepsilon} \times \mu}, \qquad \text{Equation 1}$$

where $\lambda$ is an actual wavelength of the antenna, $\lambda_0$ is a free space wavelength, $\epsilon$ is a dielectric constant and $\mu$ is a magnetic permeability.

Conventionally, an antenna has been made of glass ceramics having a dielectric rate $\epsilon$ of 4 to 7. But as seen from Equation 1, a higher dielectric constant for a shorter length of the antenna reduces the resonant length, however disadvantageously narrowing available bandwidth of antenna. Thus the dielectric constant cannot be raised infinitely. Meanwhile, for a magnetic material, a bigger magnetic permeability has little impact on a bandwidth. Therefore, a material having a dielectric constant $\epsilon$ and a magnetic permeability $\mu$, when used for an antenna substrate, can reduce the resonant length of the antenna at a greater rate than a general antenna material of a high dielectric constant (magnetic permeability=1). This shortens the length of an antenna wire, which in turn leads to further miniaturization of the antenna.

According to the invention, ferrite-resin composite having a magnetic permeability $\mu$ of 2 to 100 and a dielectric rate of 2 to 100, when used for the substrate 11, achieves bigger wavelength reduction than conventional glass ceramics having a dielectric constant $\epsilon$ of 4 to 7, thereby facilitating greater miniaturization of the antenna. Furthermore, the substrate 11 of the invention may be made of ferrite having both dielectric and magnetic properties.

The ground part 20 is formed on one end of an underside of the substrate 11 and connected to a ground part (not illustrated) configured in the mobile telecommunication terminal to ground the antenna. In the embodiment of FIG. 2 is disclosed a PIFA. But the chip antenna may be used as a monopol type antenna without the ground part 20 disposed, which is also embraced within the scope of the invention.

The feeding part 30 is connected to the spiral first radiator 40. The feeding part 30 is also connected to a circuit (not illustrated) of a mobile telecommunication terminal, from which current is fed to the first radiator 40 and meander radiating parts 70 to 72.

The first radiator 40 is connected to the ground part 20 and feeding part 30 and includes spiral radiating parts 50, 60 and 70. The spiral radiating parts 50, 60 and 70 are disposed inside or on the substrate 11. According to FIG. 2, first to third spiral radiating parts 50, 60 and 70 are disposed. The first to third spiral radiating parts 50, 60 and 70 have first to third conductive lower loops 51, 61 and 71 and first to third conductive upper loops 52, 62 and 72 connected to first to third conductive side electrodes 53, 63 and 73, respectively. The lower loops 51, 61 and 71 are disposed on an underside of the substrate 11 in a square loop configuration. Also, the upper loops 52, 62 and 72 are disposed on a top surface of the substrate 11 in a square loop configuration. The spiral radiating parts 50, 60 and 70 are defined by a square shape so that they can be sufficiently long inside or on the substrate having a rectangular parallelpiped shape.

In the first, second and third spiral radiating parts 50, 60 and 70, each of the upper and lower first, second and third loops is electrically connected to at least one corresponding loop of adjacent spiral radiating parts as follows. Out of the spiral radiating parts 50, 60 and 70, the first spiral radiating part 50 has one end of the lower loop 51 connected to the feeding part 30. Also, the first spiral radiating part 50 has the other end of the lower loop 51 connected to one end of the upper loop 52 via the first side electrode 53. The first spiral radiating part 50 has the other end of the upper loop 52 connected to one end of the upper loop 62 of the second spiral radiating part 60. The second spiral radiating part 60 has the other end of the upper loop 62 connected to one end of the lower loop via the second side electrode 63. Moreover, the second spiral radiating part 60 has the other end of the lower loop 61 connected to one end of the lower loop 71 of the third spiral radiating part 70. The third spiral radiating part 70 has the other end of the lower loop 71 connected to one end of the upper loop 72 via the third side electrode 73. In addition, the third spiral radiating part 70 has the other end of the upper loop 72 connected to the second radiator 80.

In FIG. 2, the first to third spiral radiating parts 50, 60 and 70 are arranged such that the respective first to third upper loops 52, 62, 72 and respective first to third lower loops 51, 61, 71 are stacked opposing each other in a thickness direction of the substrate 11. But the respective first to third upper loops 52, 62, 72 and respective first to third lower loops 51, 61, 71 may be stacked opposing each other in a length direction to adjust matching effects according to a radiation pattern of the antenna 10. Further, the upper loops 52, 62, 72 and lower loops 51, 61, 71 each are defined by substantially a square shape with the same size. Also, preferably, the respective upper loops 52, 62, 72 and respective lower loops 51, 61, 71 oppose each other in a symmetric configuration on and underneath the substrate 11. In FIG. 2, each of the spiral radiating parts 50, 60, 70 has a two-turn structure characterized by two patterns of the upper loops 52, 62 and 72 and lower loops 51, 61 and 71. However, the respective spiral radiating parts 50, 60, 70 may have another square-shaped loop structure (not illustrated) formed between the respective upper loops 52, 62, 72 and the respective lower loops 51, 61, 71 so that the spiral radiating parts 50, 60 and 70 may feature a multi-layer spiral structure having three or more patterns.

The respective spiral radiating parts 50, 60, 70 function to control impedance, particularly inductance of the chip antenna 10 according to the invention. Therefore, in case where a reflective parameter of the chip antenna 10 is biased toward a capacitance area on an upper hemisphere in the Smith chart, the number of the spiral radiating parts 50, 60, 70 or patterns of the respective spiral radiating parts 50, 60, 70 can be increased to enhance inductance of the chip antenna 10. In addition, the chip antenna 10 can control inductance by varying a gap between the respective upper loops 52, 62, 72 and the respective lower loops 51, 61, 71.

The second radiator 80 is connected to the first radiator 80, and as shown in FIG. 2, includes upper and lower meander radiating parts 81 and 82 formed in a meander shape having a plurality of folded unit patterns.

The upper meander radiating part 81 of the first radiator 40 is disposed on a top surface of the substrate 11. The upper meander radiating part has one end connected to the other end of the upper loop 72 of the third spiral radiating part 70, and the other end disposed in one end of the substrate 11. Also, the lower meander radiating part 82 of the first radiator 40 is disposed on an underside of the substrate 11. The lower meander radiating part 82 has one end connected to the other end of the upper meander radiating part 81 via the conductive side electrode 83. Further, the upper and lower meander radiating parts 81 and 82 are equally patterned, preferably opposing each other in a symmetric configuration on and underneath the substrate.

The second radiator 80 adjusts capacitance coupling between the upper and lower meander radiating parts 81 and 82, thus controlling impedance, particularly capacitance of the chip antenna 10 of the invention. Therefore, in case where a reflective parameter of the chip antenna 10 is biased toward an inductance area on a lower hemisphere in the Smith chart, the number of the folded unit patterns of the upper and lower meander radiating parts 81 and 82 is increased or another meander radiating part (not illustrated) may be disposed to enhance capacitance of the chip antenna 10. Also, the chip antenna 10 can control capacitance by varying a gap between the upper and lower meander radiating parts 81 and 82 or a gap between the folded unit patterns.

Figure 3:
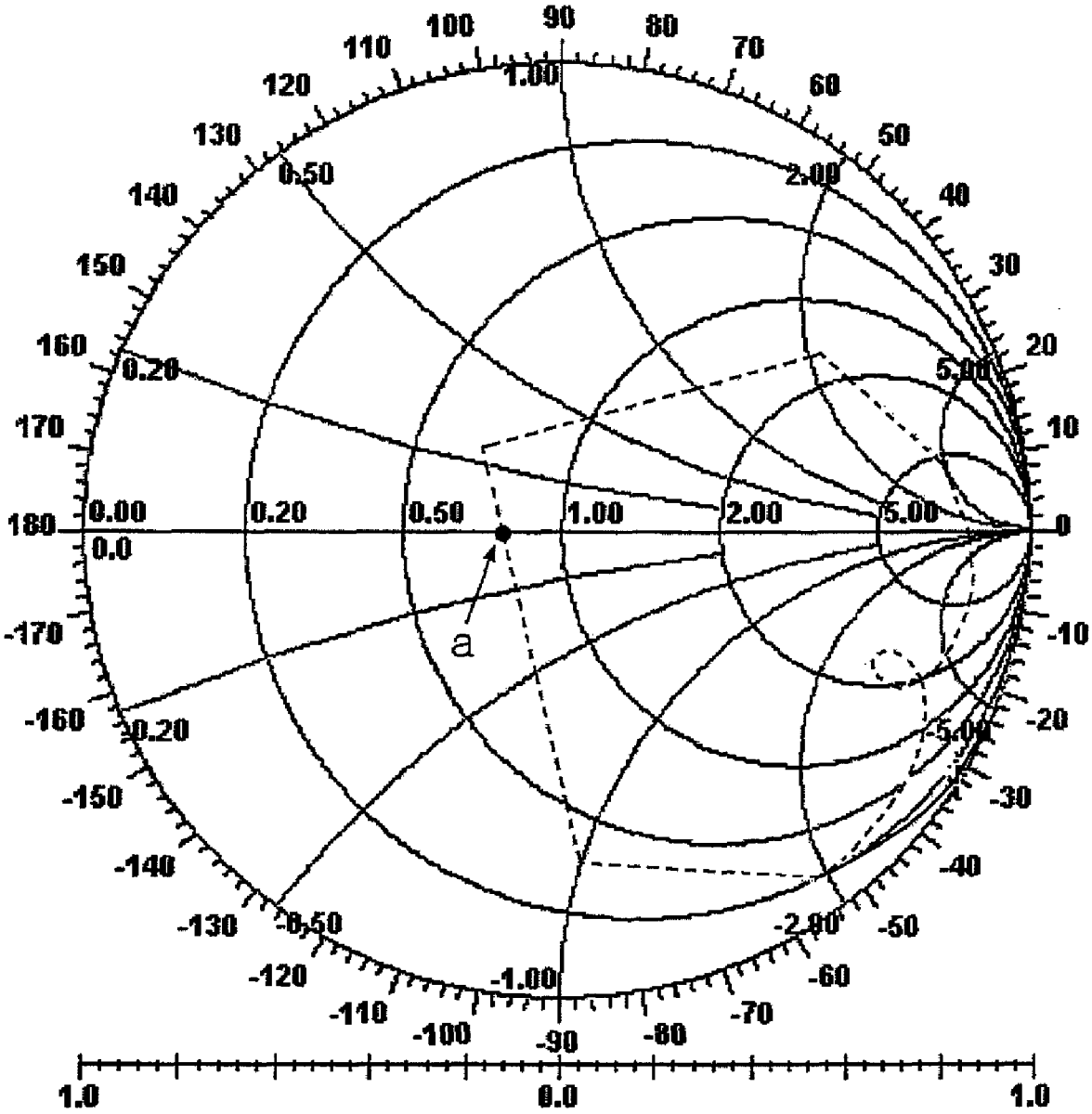
FIG. 3 is a graph illustrating VSWR properties of an internal chip antenna according to the embodiment of the invention.

FIG. 3 is a graph illustrating Voltage Standing-Wave Ration (VSWR) properties of an internal chip antenna according to the embodiment of the invention.

Referring to FIG. 3, the chip antenna 10 according to the embodiment of the invention exhibits a VSWR value of 1.65 at a point a where a reflective parameter interests a central line in the Smith chart with respect to a center frequency 200 MHz of a terrestrial DMB band. In general, a VSWR value of less than 2 indicates good matching properties of an antenna. Accordingly, the chip antenna 10 of the invention demonstrates very excellent matching properties at a center frequency 200 MHz of the terrestrial DMB band.

Figure 4:
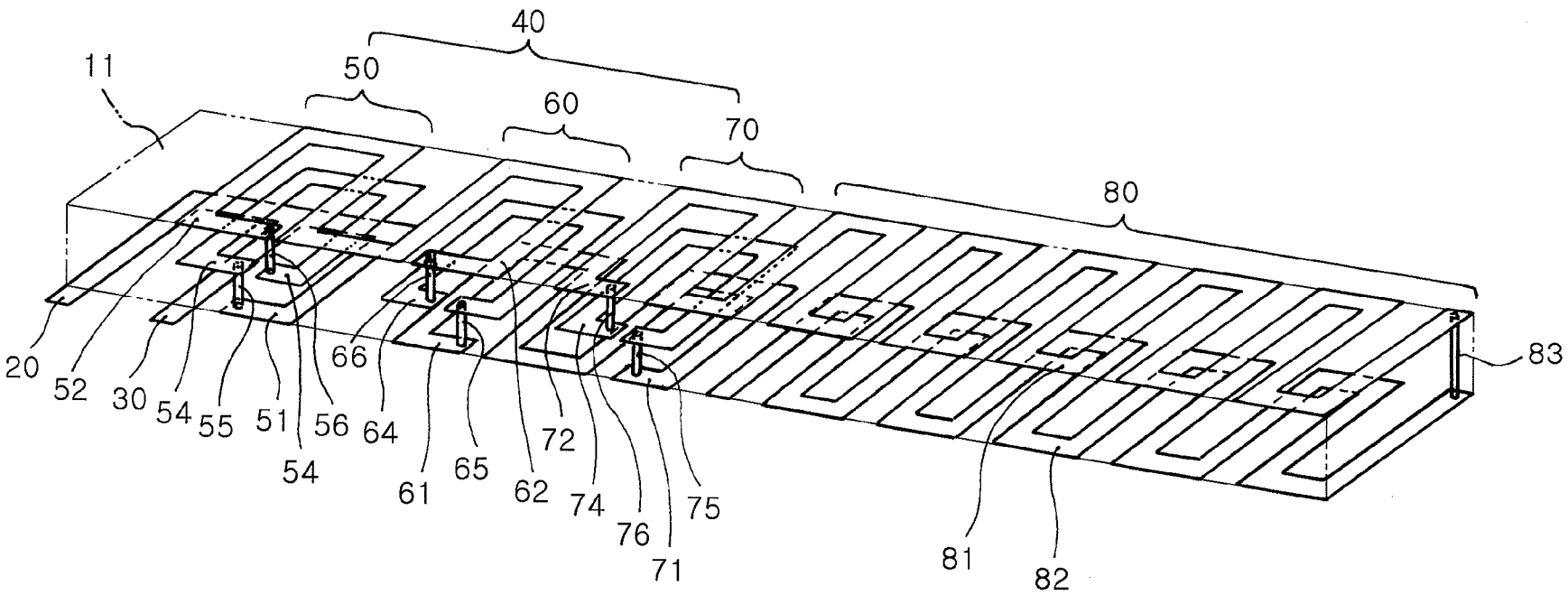
FIG. 4 is a structural view illustrating an internal chip antenna according to another embodiment of the invention.

FIG. 4 is a configuration view illustrating an internal chip antenna according to another embodiment of the invention.

Referring to FIG. 4, in the internal chip antenna according to the embodiment of the invention, respective spiral radiating parts 50, 60, 70 of a first radiator 40 further include respective intermediate loops 54, 64, 74 between respective upper loops 52, 62, 72 and respective lower loops 51, 61, 71. Also, the respective lower loops 51, 61, 71 and the respective intermediate loops 54, 64, 74 are connected to respective first side electrodes 55, 65, 75. The respective intermediate loops 54, 64, 74 and the respective upper loops 52, 62, 72 are connected to respective second side electrodes 56, 66, 76. In this fashion, the chip antenna of the invention may be configured into a multilayer spiral structure in which the spiral radiating parts 50, 60, 70 each have three or more patterns. This further increases inductance of the chip antenna and easily produces an impedance match at a low band, thereby allowing miniaturization of the antenna.

As set forth above, according to preferred embodiments of the invention, an internal antenna can be manufactured in an ultra-small size to process a signal of a low band of e.g., terrestrial DMB. Also, advantageously, inductance and capacitance of the antenna can be easily controlled via spiral and meander radiating parts.

While the present invention has been shown and described in connection with the preferred embodiments, it will be apparent to those skilled in the art that modifications and variations can be made without departing from the spirit and scope of the invention as defined by the appended claims.

What is claimed is:

1. An internal chip antenna comprising:

a substrate;

a first radiator for controlling inductance of the antenna, the first radiator formed in a spiral shape inside or on the substrate, and including at least one spiral radiating part;

a second radiator for controlling capacitance of the antenna, the second radiator connected to the first radiator and including an upper meander radiating part disposed in a length direction of the substrate and a lower meander radiating part overlapping and opposing the upper meander radiating part in a lower part of the upper meander part, and a feeding part for receiving a high frequency current of a given band, the feeding part connected to the first radiator.

2. The internal chip antenna according to claim 1, wherein the substrate comprises ferrite or ferrite-resin composite.

3. The internal chip antenna according to claim 1, wherein the spiral radiating part includes a conductive upper loop and a conductive lower loop formed in a substantially square shape, the upper and lower loops electrically connected to each other.

4. The internal chip antenna according to claim 3, wherein the spiral radiating part has at least one intermediate loop with a substantially square shape disposed between the upper and lower loops, the intermediate loop electrically connected to the upper and lower loops.

5. The internal chip antenna according to claim 3, wherein the upper and lower loops of the spiral radiating part are stacked in a thickness direction of the substrate.

6. The internal chip antenna according to claim 1, wherein the first radiator has a plurality of spiral radiating parts each having upper and lower loops, each of the upper and lower loops electrically connected to an upper or lower loop of an adjacent spiral radiating part.

7. The internal chip antenna according to claim 1, wherein the upper meander radiating part and the lower meander radiating part are electrically connected.

8. The internal chip antenna according to claim 1, wherein the radiating part and the lower meander radiating part are equally patterned, opposing each other in a symmetric configuration.

9. The internal chip antenna according to claim 1, further comprising a ground part for grounding the antenna, the ground part formed on an end of an underside of the substrate.

* * * * *